US009472100B2

(12) United States Patent
Barnes et al.

(10) Patent No.: US 9,472,100 B2
(45) Date of Patent: Oct. 18, 2016

(54) METHOD AND SYSTEM FOR VEHICLE LOCATING AND SEQUENCING

(71) Applicant: Trapeze Software ULC, Mississauga (CA)

(72) Inventors: Sharon Ann Irma Barnes, Kelowna (CA); Marty Charles Brooks, Kelowna (CA); Paul Anthony Ernsdorff, Spokane, WA (US); Dylan Gray, Spokane, WA (US); Warren Malcolm Pennington Scott, Kelowna (CA)

(73) Assignee: Trapeze Software ULC, Mississauga (CA)

( * ) Notice: Subject to any disclaimer, the term of this patent is extended or adjusted under 35 U.S.C. 154(b) by 132 days.

(21) Appl. No.: 14/464,450

(22) Filed: Aug. 20, 2014

(65) Prior Publication Data

US 2016/0055748 A1 Feb. 25, 2016

(51) Int. Cl.
*G08G 1/14* (2006.01)
*G08G 1/00* (2006.01)

(52) U.S. Cl.
CPC ..... *G08G 1/141* (2013.01); *G08G 1/143* (2013.01); *G08G 1/146* (2013.01); *G08G 1/149* (2013.01); *G08G 1/205* (2013.01)

(58) Field of Classification Search
CPC ..... G08G 1/141
USPC ..... 340/932.2; 709/220
See application file for complete search history.

(56) References Cited

U.S. PATENT DOCUMENTS

| | | | | |
|---|---|---|---|---|
| 7,899,583 | B2 * | 3/2011 | Mendelson | 701/1 |
| 8,334,792 | B2 * | 12/2012 | Kim | 340/932.2 |
| 8,786,465 | B2 * | 7/2014 | Bouzaglo | 340/932.2 |
| 2006/0187043 | A1 * | 8/2006 | Allen | G06Q 10/087 340/572.1 |

* cited by examiner

*Primary Examiner* — Brent Swarthout
(74) *Attorney, Agent, or Firm* — Elan IP Inc.

(57) ABSTRACT

There is a system for RFID tag-based vehicle locating and sequencing at a site comprising a first vehicle or movable asset, having at least one tag, and a plurality of other vehicles in the site having tags and reference tags located within the site, whereby the communication between the first vehicle and other ATs and RTs allow locating (in one of a parking spot, a virtual parking spot or a boundary) and sequencing of the first asset.

21 Claims, 7 Drawing Sheets

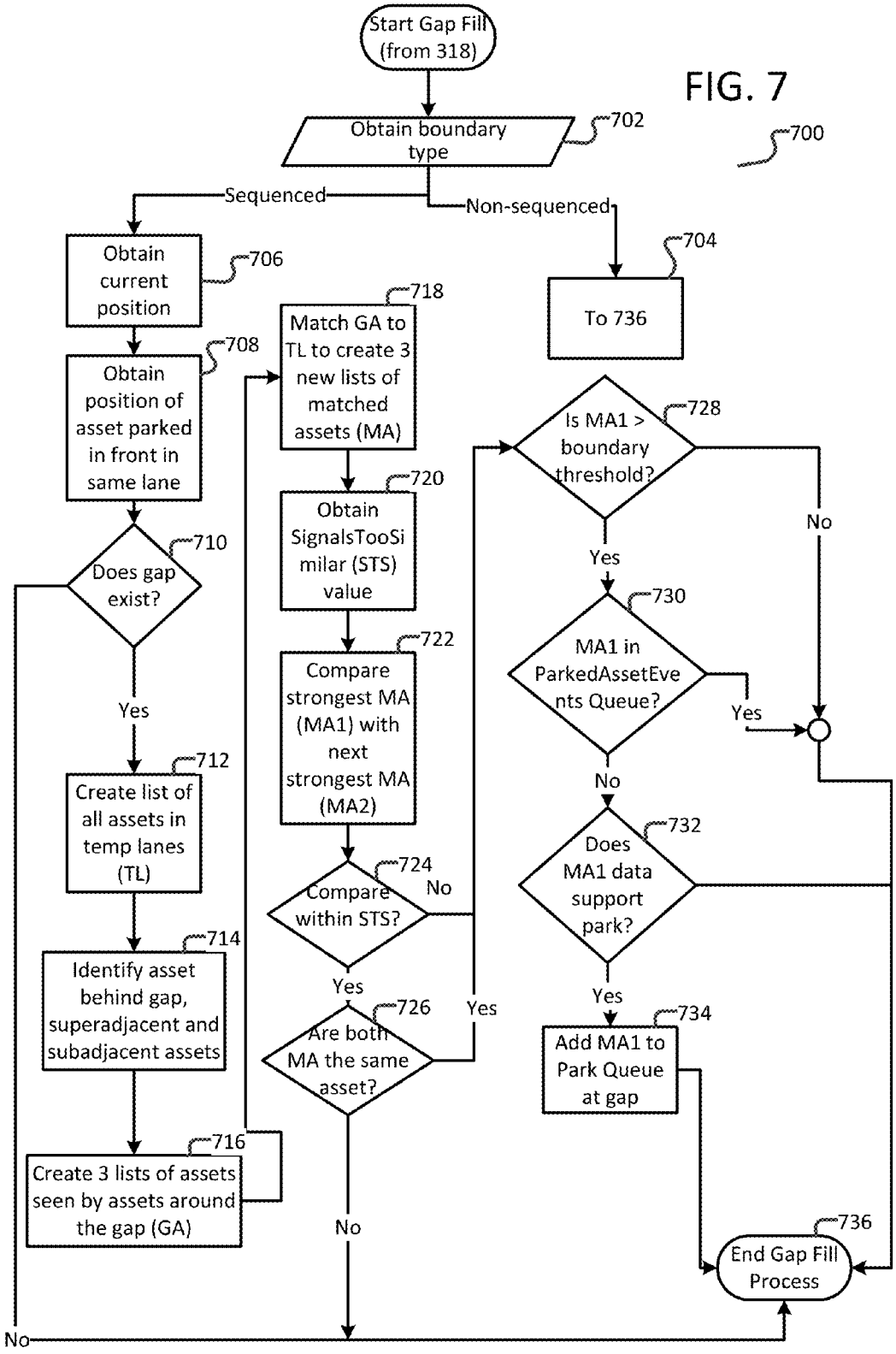
FIG. 7
700
Start Gap Fill (from 318)
Obtain boundary type
702
Sequenced
Non-sequenced
704
To 736
Obtain current position
706
Obtain position of asset parked in front in same lane
708
Does gap exist?
710
Yes
No
Create list of all assets in temp lanes (TL)
712
Identify asset behind gap, superadjacent and subadjacent assets
714
Create 3 lists of assets seen by assets around the gap (GA)
716
Match GA to TL to create 3 new lists of matched assets (MA)
718
Obtain SignalsTooSimilar (STS) value
720
Compare strongest MA (MA1) with next strongest MA (MA2)
722
Compare within STS?
724
Yes
No
Are both MA the same asset?
726
Yes
No
Is MA1 > boundary threshold?
728
Yes
No
MA1 in ParkedAssetEvents Queue?
730
Yes
No
Does MA1 data support park?
732
Yes
Add MA1 to Park Queue at gap
734
End Gap Fill Process
736

METHOD AND SYSTEM FOR VEHICLE LOCATING AND SEQUENCING

FIELD OF THE INVENTION

The present invention relates generally to systems and methods for vehicle sequencing. More particularly, the present invention relates to locating and sequencing of vehicles or assets in one or more locating/parking areas or lanes.

BACKGROUND OF THE INVENTION

Attempts to locate vehicles for sequencing is a well-known problem. In order to efficiently assign drivers to vehicles, and provide an efficient way to move vehicles in and out of parking lanes/lots, it is desirable to know precisely where those vehicles are. Precise knowledge includes physical locations (such as what parking spot they are in, which may include lanes and spots within lanes) and which vehicles they are in front of, behind, or beside.

Various approaches have been attempted to locate and sequence vehicles, including using GPS technologies. However, the accuracy of such approaches is often not granular or accurate enough (often mistaking which lane a vehicle may be in as lanes may be essentially directly beside each other) and is also only available when a GPS signal is available (which is often not the case when in an indoor parking lot, for example). Approaches using RFID have thus far proven unreliable in accurately determining locations, and have resulted in widespread failure when one or more locations of vehicles are incorrectly determined.

There thus remains a need for systems and methods to locate and sequence assets, such as vehicles, at a site.

SUMMARY OF THE INVENTION

There is a method for tag-based locating of moveable assets, at a site having one or more pre-existing moveable assets therein, each having one or more pre-existing moveable asset tags (pAT), the site further having one or more reference tags (RT), and the moveable assets having an asset tag (AT) thereon, the system comprising: receiving a signal set comprising a signal from each pAT and RT at the site within a communicable range of the AT; consolidating the signal data set into a consolidated signal data set by applying one or more consolidation rules to the signal set; communicating the consolidated signal set to a location management system; obtaining a set of potential parks for the AT; applying one or more local analyses to the set of potential parks for the AT; and specifying a current parking result for the AT based on the applying.

The consolidation rules may comprise: rejecting i) any signal that is below a threshold signal strength and ii) any signal that is weaker than a strongest signal in the signal data set by more than a threshold signal strength difference.

The obtaining further may comprise: for each signal in the consolidated signal data set, considering each potential park rules in a set of potential park rule; and adding a potential park to the set of potential parks if the considering results in a potential park.

The potential park rules may comprise: if a signal in the consolidated signal data set includes a signal from an RT, then a potential park is proximate to the RT; and if a signal in the consolidated signal data set includes a signal from an AT, then a potential park is proximate to the AT.

The potential park rules may further comprise: if a signal in the consolidated signal data set includes a signal from an AT in a virtual parking spot, then a potential park is proximate to the AT and in a virtual lane.

The method may further comprise: requesting a signal data set based on a trigger. The trigger may be one of a stopped trigger, motion trigger or a stationary trigger.

The method may further comprise: storing a prior parking result for the asset; if the prior parking result is a real parking spot or a virtual parking spot then; validating the prior parking result; if the prior parking result is validated then: setting the current parking result to be the same as the prior parking spot.

The validating may further comprise: retrieving a prior signal data set for the asset; comparing the prior signal data set to the current signal data set; and if the prior signal data set is equivalent to the current signal data set then: issuing a validation.

The current parking result may be i) a parking spot if AT is in a parking spot, ii) a boundary if AT is in a boundary and iii) a virtual parking spot if AT is not in a parking spot or a boundary.

There is also a system for tag-based locating of moveable assets, at a site having one or more pre-existing moveable assets therein, each having one or more pre-existing moveable asset tags (pAT), the site further having one or more reference tags (RT), and the moveable assets having an asset tag (AT) thereon, the system comprising: a moveable asset to locate at a site, the asset having an AT thereon operable to communicate with pATs and RTs, the AT configured to: receive a signal set comprising a signal from each pAT and RT at the site within a communicable range of the AT; communicate the consolidated signal set to a location management system; and a location management system configured to: consolidate the signal data set into a consolidated signal data set by applying one or more consolidation rules to the signal set; obtaining a set of potential parks for the AT; applying one or more local analyses to the set of potential parks for the AT; and specifying a current parking result for the AT based on the applying.

The consolidation rules may comprise: rejecting i) any signal that is below a threshold signal strength and ii) any signal that is weaker than a strongest signal in the signal data set by more than a threshold signal strength difference.

The obtaining may further comprise: for each signal in the consolidated signal data set, considering each potential park rules in a set of potential park rule; and adding a potential park to the set of potential parks if the considering results in a potential park.

The potential park rules may comprise: if a signal in the consolidated signal data set includes a signal from an RT, then a potential park is proximate to the RT; and if a signal in the consolidated signal data set includes a signal from an AT, then a potential park is proximate to the AT and may further comprise: if a signal in the consolidated signal data set includes a signal from an AT in a virtual parking spot, then a potential park is proximate to the AT and in a virtual lane.

The system may further comprise: requesting a signal data set based on a trigger.

The trigger may be one of a stopped trigger, motion trigger or a stationary trigger.

The location management system may be further configured to: store a prior parking result for the asset; if the prior parking result is a real parking spot or a virtual parking spot then; validate the prior parking result; if the prior parking result is validated then: set the current parking result to be the same as the prior parking spot.

The location management system may be further configured, to validate the prior parking, to: retrieve a prior signal data set for the asset; compare the prior signal data set to the current signal data set; and if the prior signal data set is equivalent to the current signal data set then: issue a validation.

The current parking result may be i) a parking spot if AT is in a parking spot, ii) a boundary if AT is in a boundary and iii) a virtual parking spot if AT is not in a parking spot or a boundary.

BRIEF DESCRIPTION OF THE DRAWINGS

Embodiments will now be described, by way of example only, with reference to the attached Figures, wherein:

FIG. 7 shows a method for parking calculation for filling parking gaps according to an embodiment of the invention.

DETAILED DESCRIPTION OF THE EMBODIMENTS

Figure 1:
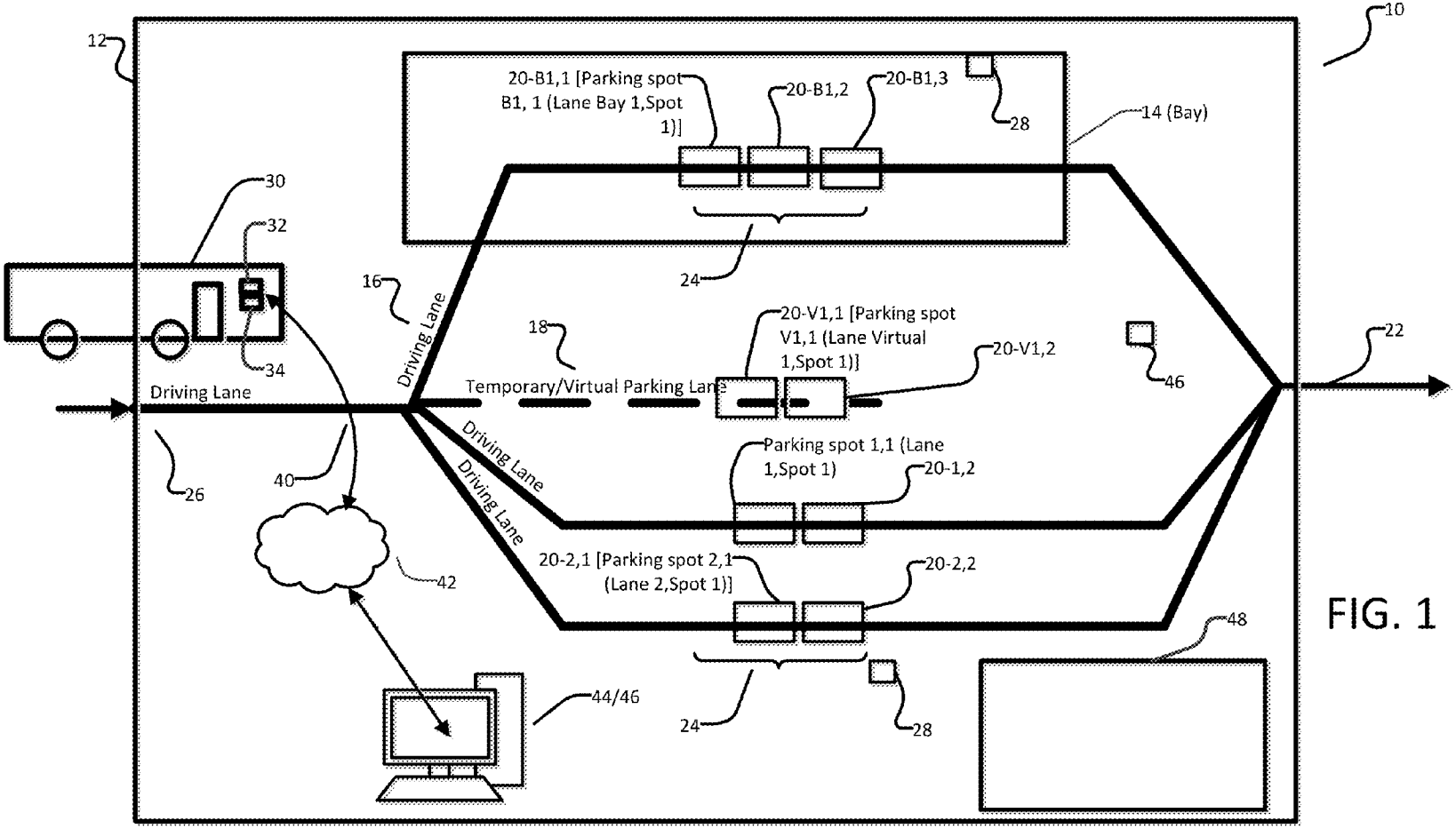
FIG. 1 shows a high-level architecture of a system for RFID based vehicle locating and sequencing according to an embodiment of the invention.

FIG. 1 shows a high-level architecture of a system for vehicle locating and sequencing according to an embodiment of the invention comprising system 10 further comprising one or more vehicles (moveable assets) 30, each further comprising tag 32, site 12 (having an entrance 26 and an exit 22), further comprising bay 14, one or more driving lanes 16, one or more temporary or virtual lanes 18, one or more parking spots 20, one or more reference tags 28, mobile data terminal 34, gateways 46, and location management system 44, asset 30 further comprising asset tag 32, boundary/parking zone 48, and communication network 42.

Site 12 may be any location where moveable assets need to be located and sequenced. Examples may include bus depots, vehicle storage sites, shipping container storage areas (including on ships or on land), and the like. Site 10 may comprise outdoor areas and/or indoor areas in which moveable assets may be placed or kept, requiring locating and sequencing. Site 12 may have at least some areas where GPS signals are not available.

Site 12 may be a location at which users of system 10 would like to track assets 30 (such as the detailed and exaction location or placement of assets 30). Site 12 may be a location where assets 30 are stored, or may be another location of interest to system 10. Site 12 may be a physically bounded area, with only a limited number of entry/exit points such as entrance 26 and exit 22. Alternatively, site 12 may not be physically bounded but only be a defined area of interest for system 12, for example defined by streets or geographic coordinates. In a transit application, for example and as shown in FIG. 1, site 12 may be or include a transit bay 14 where assets 30, potentially transit vehicles, go for maintenance and storage when they are not being used, driving lanes 16, boundaries 34, parking lanes 24 (which may be in bay 14, site 12, or may be virtual and/or made up of virtual parking spots 20-V).

Moveable assets 30 (or simply 'assets') may be vehicles (such as buses, trains, streetcars or fleet vehicles) or other moveable assets. Moveable assets 30 may be parked, for example when they are not in use, in site 12. Assets 30 may enter site 12 via entrance 26 and may then be parked in a parking spot. The owner/operator of asset 30 and/or site 12 may want to know the location of each asset 30 (for planning and future use purposes, such as to organize how to effectively put the asset back in use during the next day, according to a bus schedule for example). The location of an asset 30 may be the parking spot 20 the asset is in. The location may be determined via communications between asset 30, other assets 30, gateways 28, and location management system 44.

Asset 30 comprises mobile data terminal (MDT) 34 thereon or therein, though possibly being removable therefrom. MDT 34 may be removably attached to asset 30. MDT 34 may be computing devices that may take user input (such as keystrokes, clicks, touch inputs, and the like) and provides the user interface to functionality relating to, for example, the provision of transit services, driver or vehicle evaluation, and acceleration monitoring, and interacting with location management system 44 and the software located thereon. MDT 34 may have software running thereon to accept inputs as described herein, provide outputs as described herein, and communicate with other elements of system 10 as described herein. MDT 34 may have features of many tablets, smartphones, rugged PCs, and the like, such as one or more screens, memory, processors, cameras, communication modules (Bluetooth, RFID, cellular, WiFi, NFC, etc), and user inputs (touchscreens, buttons, etc).

MDT 34 may be able to communicate with other elements of system 10 (such as ATs 32 located thereon, or nearby, RTs 28, location management system 44 and the like), for example by communication network 42, or directly such as may be the case with other systems of vehicle 14. One exemplary MDT 32 may be Ranger 4™, made by Trapeze Software™.

Assets 30 may further comprise RFID asset tag 32 (referred to herein interchangeably as "tag 32", "asset tag 32" or "AT 32"). Tag 32 may communicate via RFID (or similar communication that allows local communication, including in various frequency bands as required) with other assets 30, gateways 28, and location management system 44 (that may have or be RT 28). Asset 18 may comprise other components and systems (not shown) including, but not limited to, electrical, mechanical and computer systems and sensors 22, various of such systems requiring or being capable of monitoring.

Tags 32 may be located thereon or therein, and may be removably attached. Tags 32 may operate in one or more "states" that govern their functioning. Tags 32 may transmit a beacon signal for a particular duration (transmission duration) every few seconds (or other transmission interval) and may listen for other signals for a particular duration (reception duration) every few seconds (reception interval). The location of asset tag 32 on asset 30 may be used to optimize communication ranges, reduce power consumption, and increase the ease of locating and sequencing (for example, placing tag 32 at the front of asset 30 may be more helpful than placing it somewhere between the front and back; and placing tags 32 at the same general location on each asset may also be assistive). Each asset 30 may have one or more tag 32 (such as the front of asset 30 and at the back of asset 30). In one embodiment asset 30 that is to be sequenced has a tag 32 on two opposing sides of asset 30 (i.e. the front and back or two sides) while assets 30 that are to be stacked may require two pairs of opposing sides (i.e. front and back, top and bottom). Tag 32 may be able to retrieve and/or determine information relevant to asset 30 (status information), for example its location or information from other components (not shown) of assets 30, site 12, or gateways 28, for example from one or more sensors, and transmit that information to other assets 30, gateways 28, or location management system 44 when they are within range, allowing asset 30 to communicate with system 10 (for example providing status information to location management system 44) to provide the functionality described herein. ATs 32 (and RTs 28) may comprise a processor, memory or storage, and other features typical of RFID tags and gateways, that may allow accomplishing of functionality described herein.

Asset tag 32 may further comprise a plurality of sensors, or be operably connected to sensors, that allow it to gather information regarding asset's 30 status. Each of such sensors may be operably connected to tags 32.

Parking spots 20 may substantially be any parking spot in site 12. Parking spots 20 may be pre-determined or ad-hoc (for example just being where asset 30 stops), may be part of a parking lane 24 or separate, may be in a bay 14 or anywhere else in site 12, and may be a virtual parking spot 20-V. Virtual parking spot 20-V may be created or used when the location of an asset does not appear to correspond to another parking spot 20, such that location management system 44 has not conclusively determined asset's 30 location. Each parking spot 20 may be uniquely identified or identifiable in computing system 44. Many conventions for identifying may be used, but in one example parking spots may be described as being in bay 14 ("B"), virtual (V) or regular (no designation), and assigned a unique lane number and spot number within the lane.

Parking spots 20 may apply where assets 30 are vehicles. In other embodiments (such as for storage containers), parking spots 20 may be storage locations or another equivalent term. Of course parking lanes may then be similarly replaced. However, despite the differences in nomenclature and organization of places to locate and sequence assets, aspects of the present invention may be tailored to accomplish locating and sequencing of assets 30.

Driving lanes 16 may allow assets 30 to drive (or be driven) through site 12 in order to arrive at a parking spot 20 or exit 22. Driving lanes 16 may become parking lanes 24 at some point in site 12, and may return to driving lanes 16 (and this may occur through the day as assets 30 are driven out of site 12). Driving lanes 16 may have one or more configurations that may be set up, for example, in central management system 44. Those may indicate what types of assets 30 should be in that lane or parked in that lane, and may provide further parking hints (as described herein). Virtual lane 18 may be made up of one or more virtual parking spaces, generally in a row or line. Virtual lanes may be used, for example, where multiple buses are determined to be in a row, but system 10 cannot determine which actual lane they are in (hence a virtual lane is used so as to indicate that such buses are in a row, but that they are not in a known lane yet).

Reference tag 28 (referred to herein interchangeably as "reference tag 28" or "RT 28") communicates via RFID with other gateways 46 and tags 32. RTs 28 may be similar to ATs 32 but may not change states. This may be accomplished, for example, by turning off an embedded motion sensor—not shown—which means states do not change. State changes may not be required by RTs as RTs 28 may be connected to a power source and thus conservation of battery power may not be important. To do so, RT 28 may initiate communication or tag 32 may initiate communication. RT 28 may transmit an RFID communication signal (shown as line 40) that 'awakens' RFID tag 32 from a 'sleep' or 'wait' state (an "awaken signal"), for example if the transmission matches requirements of a particular RFID tag 32. RFID tag 32 may then transmit its information (such as sensor information as described herein), for example to gateway 46. RT 28 may receive transmissions from one or more asset tags 32 via RFID communications and provide those transmissions to location management system 44 via communication network 26 (such as to perform operations, for example to monitor asset 30). RTs 28 may be placed throughout site 12 so that they can communicate information with assets 30, and provide/gather information assisting in locating and sequencing assets 30. In one embodiment RTs 28 may be scattered in boundary (or parking zone) 34 and one in each bay 14, in lanes you have at front and then may put RTs at prescribed intervals down lane say several bus lengths, generally by walkways or driving lanes or something that crosses your parking lane. By way of example, RT 28 may be placed proximate to the first and last parking spot in each parking lane 24, parking spot 20, or other location where assets 30 sometimes stop. RT 28 may also be placed at entrance 26 and exit 22 to assist in determining when asset 30 has entered or exited site 12 (i.e. placing RTs 28 at a chokepoint). In one embodiment for lanes, RTs 28 may be located at the front of each lane and periodically throughout lane (by distance or geographic items like fire lanes, but generally where the front of a bus would stop). For adjoining lanes that are side by side, RTs 28 may be similarly placed in each lane. Spacing may also be prescribed by legislation, for example to allow emergency responses. RTs for discrete parking spaces 20 may be placed at the front of each space. For boundaries 34, RTs 28 could go either at or along the perimeter of boundary 34 or down the center of the boundary, depending on how they park or if there's an immediately adjacent zone that needs to be clearly differentiates (for example where one boundary 34 is for tire assets 30 requiring tire inflation, and another boundary 34, immediately adjacent and not physically separated, is assets 30 requiring maintenance).

It is to be understood that any elements of system 10 that are called "tags" (such as tag 32, RT 28, and the like) may be tags in the sense that they may generally be able to receive and transmit via RFID. Of course all such elements may simply be readers. Hence tags (such as RT 28 and AT 32) may generically be referred to as nodes, where nodes may be either tags or readers.

Gateways 46 may be similar to RTs 28 and further able to bridge the communication between RTs 28 and tags 32 into other networks (such as communication network 42)—essentially acting as a gateway between two modes of communication that otherwise may not inter-communicate.

Central management system 44 may be a component of system 10 that provides functionality for users relating to one or more assets 30, such as to operate one or more transit services for a fleet of assets 30. Such functionality may include tracking the location and sequencing of assets 30, scheduling assets' use, diagnosing any issues with asset 30 that may require servicing, and scheduling any service work that may be required for asset 30. Central management system 16 may compile information from one or more gateways 14 or assets 30, via communication network 42 or RFID, with other information, for use in providing functionality of system 10 and location management system 44. Central management system 44 may be implemented via one or more pieces of software and may be operated by one or more users. Though it is shown in the figure as one computer, it can be composed of one or more computing and data storage devices and its functionality can be split up across these devices as appropriate. Of course location management system 44 may provide functionality not related to locating and sequencing. Central management system 16 is shown as within site 10, but may be located anywhere, including remote from site 10 (though possibly still accessible from within site 10). Central management system 44 may comprise components as described herein, and may include storage (to store data communicated with and between RTs 28 and ATs 32.

Components that communicate wirelessly in system 10, for example tag 32 and RT 28, have both a transmission range and a reception range. The transmission range denotes the distance which a component can transmit a signal to any other components within system 100, while the reception range of a component denotes the distance within which the component can hear signals. Components of system 10 are said to be in communicable range of each other when the reception range of a first component overlaps with the transmission range of a second, or the transmission range of the first component overlaps with the reception range of the second. When this is not true, the components are said to be out of communicable range of each other. If the reception ranges of both components overlap with the other component's transmission range, the components are said to be in bi-directional communicable range. Generally, the further two components are from each other, the weaker the signals exchanged may be—allowing gateways 28 and tags 32 to estimate the distance from, and importance, of signals being received. Each of RT 28 and AT 32 can configure their settings and components to adjust the strength of receiving and transmitting abilities, as required by the particular implementation.

Communication network 42 may enable communication of information between various components of system 10 including, but not limited to, RT 28 and location management system 44. Communication network 42 allows for a plurality of signals or information to be sent through its network simultaneously. Communication network 42 may be any public or private network, wired or wireless, and may be substantially comprised of one or more networks that may be able to communicate with each other. Communication network 42 may use a variety of mediums, such as cellular and WiFi networks. Communication networks 42 may not be required, for example, if components of system 10, such as RT 28 and location management system 44 are able to communicate directly, such as via RFID communications.

Figure 2:
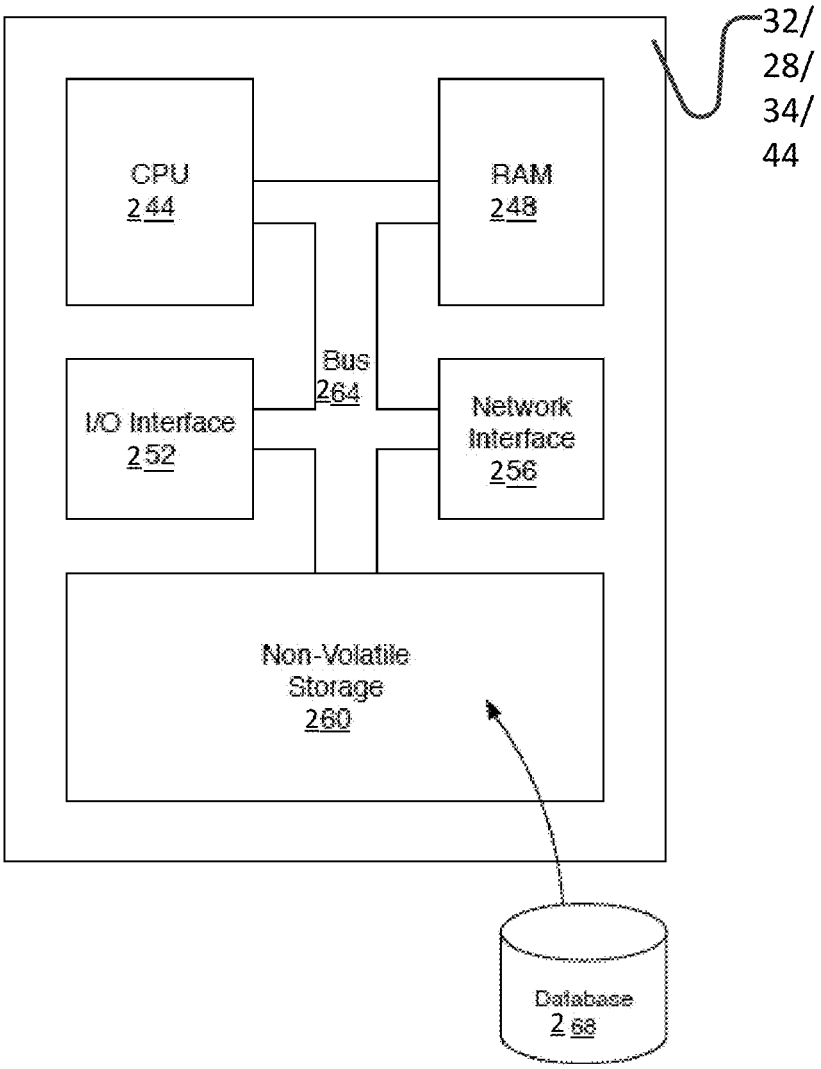
FIG. 2 shows a number of components of aspects of a system according to an embodiment of the invention.

FIG. 2 shows a number of components of location management system 44 (and MDT 34) in FIG. 1. As shown, location management system 44 has a number of components, including a central processing unit ("CPU") 244 (also referred to simply as a "processor"), random access memory ("RAM") 248, an input/output interface 252, a network interface 256, non-volatile storage 260, and a local bus 264 enabling the CPU 244 to communicate with the other components. CPU 244 executes an operating system and programs that provide the desired functionality. RAM 248 provides relatively-responsive volatile storage to CPU 244. The input/output interface 252 allows for input to be received or provided from one or more devices, such as a keyboard, a mouse, a touchscreen, etc., and enables CPU 244 to present output to a user via a monitor, a speaker, a screen, etc. Network interface 256 permits communication with other systems for receiving itinerary planning requests and for providing itinerary responses, in the form of web pages. Non-volatile storage 260 stores the operating system and programs, including computer-executable instructions for itinerary planning During operation of location management system 44, the operating system, the programs and the data may be retrieved from the non-volatile storage 260 and placed in RAM 248 to facilitate execution.

Figure 3:
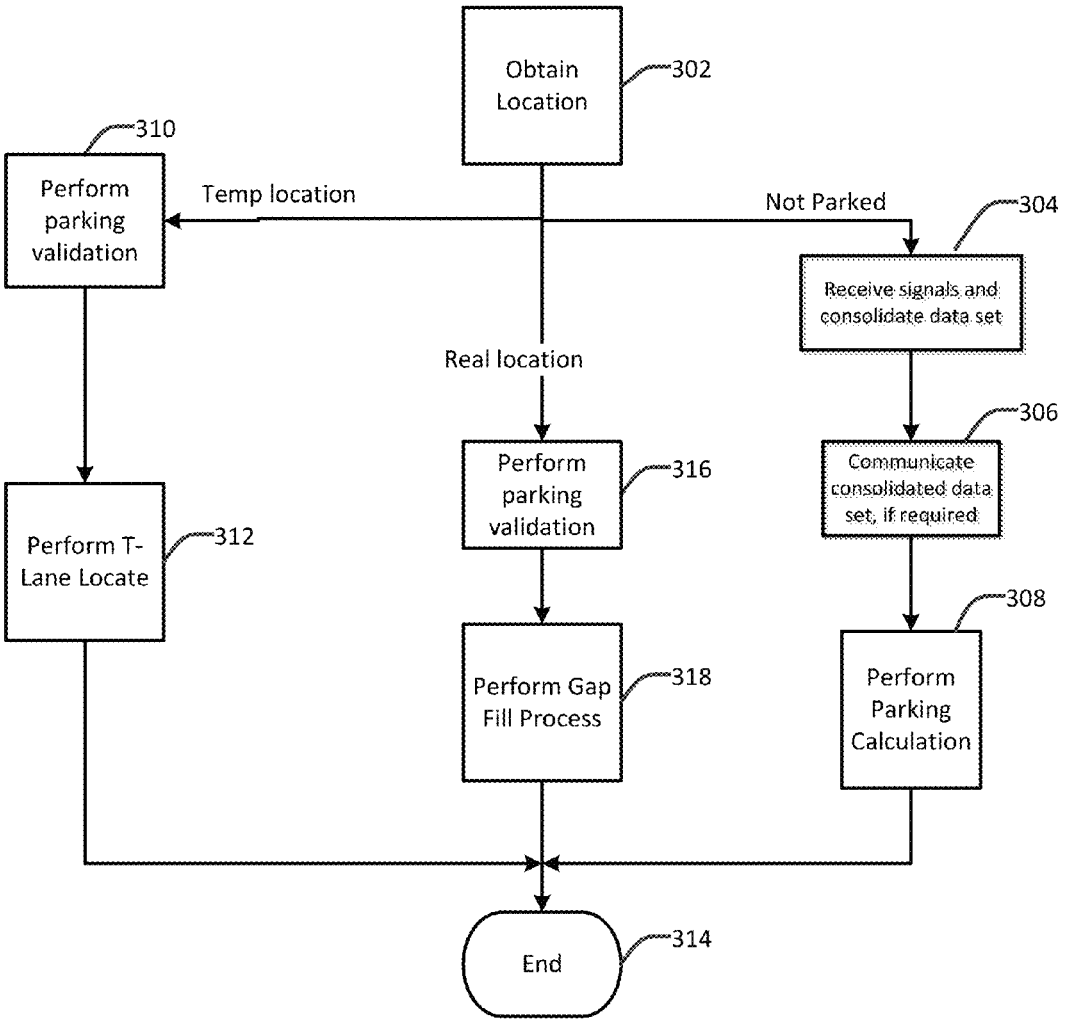
FIG. 3 shows a method for locating assets according to an embodiment of the invention.

FIG. 3 shows a method 300 for locating and sequencing stopped assets according to an embodiment of the invention.

Method 300 begins at 302 where a location is obtained for asset 30 (i.e. a prior parking result). This may be done by LMS 44, for example looking up whether the particular asset 30 has a stored location (which may be a parking spot, for example). A request to obtain location may be triggered in many different ways, and may depend on what state asset 30 is in (a stopped trigger, a motion trigger, or a stationary trigger, that may be initiated by an accelerometer, not shown, in AT 32), for example based on timing or motion detection, powering on or off of an asset 30, other systems of asset 30 (such as systems that may be connected to an OBD-II computer), and the like. For example if asset 30 is in a stationary state an obtain location trigger may be infrequently triggered (or not at all), in a stopped state triggers may occur every few seconds until the asset 30 is in a stationary state. Of course many approaches to determining when to obtain a location are possible.

If there is no location obtained at 302 then method 300 continues to 304. At 304 signals are received by asset 30 into a signal data set and one or more signal consolidation rules are applied to obtain a consolidated signal data set.

Asset 30 receives any and all signals from ATs 32 (largely being other assets 30 somewhat proximate to asset 30, also referred to herein as pre-existing ATs) and RTs 28 (largely being reference tags somewhat proximate to asset 30) and gateways 46 that are in communicable range of asset 30. Asset 30 may not, initially ignore any such signals.

One or more consolidation rules may then be applied, generally by AT 32, to obtain a consolidated signal data set and avoid unnecessary communication from tag 32 (which may be desirable to conserve battery power). Generally the consolidation rules would be designed such that the consolidated signal data set reflects only the most meaningful signals that help locate and sequence asset 30. Exemplary consolidation rules may include (and may be combined as a set thereof):

1) Discarding tag data below thresholds, for example −75 dB, though the actual threshold would depend largely on the configuration of parking spaces, RTs, ATs, FCC or hardware implications/restrictions and other considerations and may generally be in the range of −40 dB to −120 dB;
2) Discard AT data >5 dB weaker than strongest AT (5 dB being configurable);
3) Discard RT data >5 dB weaker than strongest RT (5 dB being configurable).

After consolidating at 304, AT 32 may send the consolidated signal data set to location management system 44, optionally via gateway 46, for further processing at 306.

Figure 4:
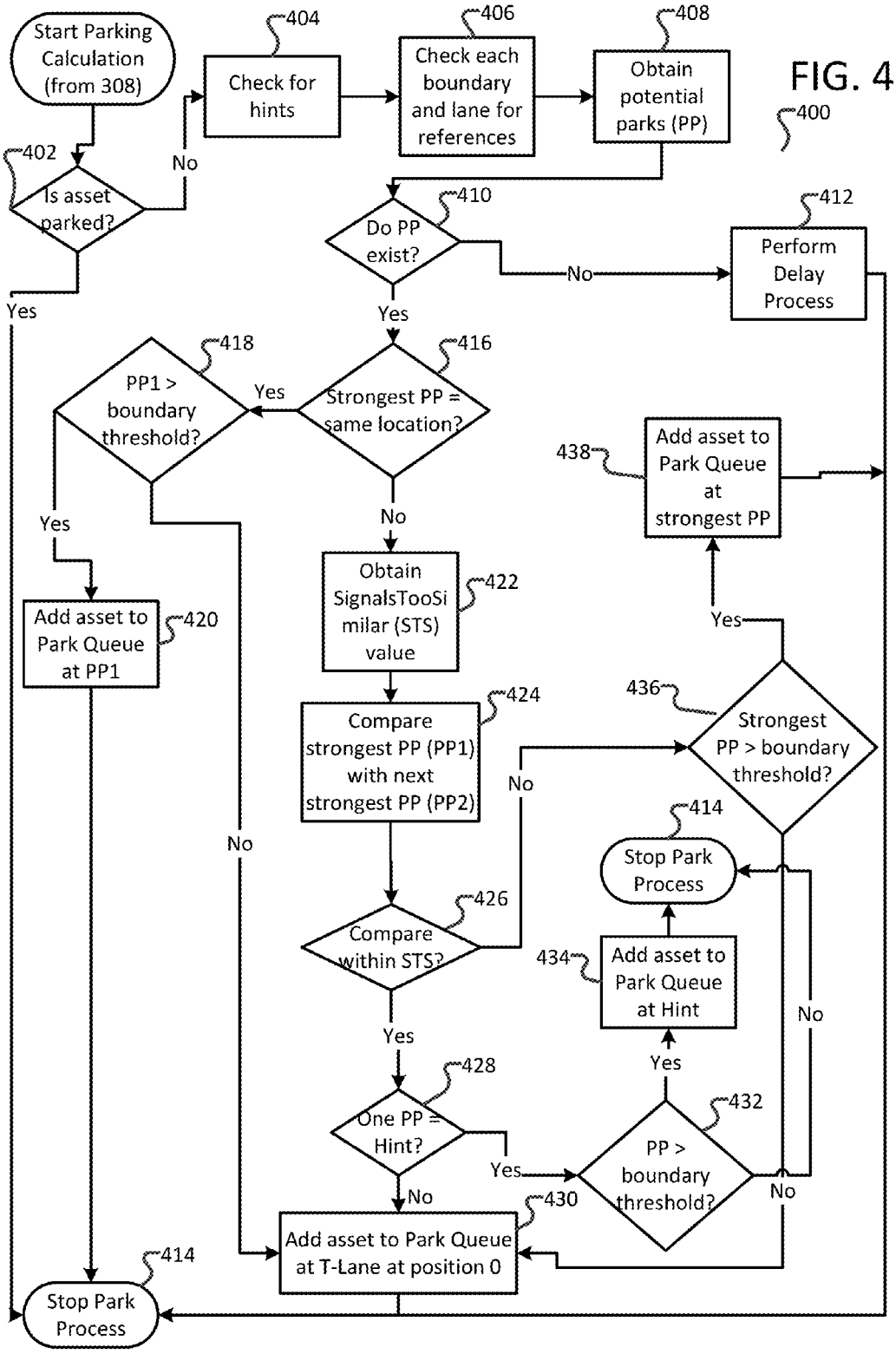
FIG. 4 shows a method for a parking determination according to an embodiment of the invention.

Method 300 then continues at 308 to perform a parking calculation—as described herein and with respect to FIG. 4. It should be noted, in beginning 308 and method 400, that such methods use the consolidated signal data set they are presented. However, the methods may be initiated based on one or more consolidated signal data sets that may relate to essentially the same event/issue/tag 32, for example if i) LMS 44 receives the same consolidated signal data set more than once ii) LMS 44 receives multiple consolidated signal data sets that are in fact related (for example if two more triggers occur within a short period of time) iii) any other aspect of system 10, or any components (not shown) that also leverage or affect system 10, introduce copies or delays, and iv) any combination of the above occurs. In such cases where there are effectively duplicate consolidated signal data sets a further filtering of consolidated signal data sets may occur at LMS 44, either prior to or during methods 400/500/600/700, to avoid processing duplicates (such as by looking at time stamps that may be part of the consolidated signal data sets, time of receipt by a gateway, content of the different consolidated signal data set, and the like).

If the location is a real location (such as a real parking spot, in a lane or otherwise, or in a boundary) then method 300 continues to 306 to perform a parking validation and then a gap fill process at 308—both as described herein. If the location is a temporary or virtual location (such as a virtual parking spot) then method 300 continues to 310 to perform a parking validation (which may be substantially the same as parking validation 306) and then a t-lane locate at 312—both as described herein. Method 300 then ends at 314 until a location is to be obtained again.

From 308 method 300 continues to method 400 in FIG. 4. Method 400 determines, or attempts to determine, where asset 30 is located in site 12. Of course the analyses herein are exemplary and others, including combinations of those described herein and related analyses, may be considered. The order of the analyses may also be altered, for example to reduce processing. Further, although various analyses and potential parks are described herein, different analyses and potential parks may result in different confidence about the parking calculation for asset 30 and may still be used. Analyses may be based on the consolidated signal data set, other information from one or more of asset 30, location management system 44, ATs 32 and RTs 28 (such as parking spots that are currently full, spots that have been assigned, closest parking spots, spots that fit certain vehicles only, and the like).

Method 400 begins at 402 where if asset 30 is parked then method 400 ends. If it is not parked then method 400 continues at 404 to check for hints.

At 404 hint data (independent indicators) is checked. Hint data may include:

1. a lane that location management system 44 has indicated to asset 30 it should park in (for example where location management system 44 sent an intended lane to MDT 34 and MDT 34 displayed this lane so that the operator of asset 30 could park asset 30 in the intended lane or where an LED sign, such as a chokepoint sign located at an entrance or a wayside sign), this may be because of configurations of parking lane 16 and asset 30 in question and eliminating parking spots/lanes that are outside bay 14 when a chokepoint has indicated that asset 30 is in bay 14 or because of known patterns for the next use of assets 30;
2. location management system 44 has indicated to asset 30 that it needs maintenance/fuel/washing/tire rotation/inspection and maintenance or other servicing is performed in one or more lanes or parking spots that may be in bay 14;
3. driver of asset 30 knows that they are only stopping at site 12 briefly and thus tells location management system 44 (for example via MDT 34) that it will stop in a boundary (or some other suitable location) so that it can exit quickly.

Checking hint data at 404 may be using consolidated signal data set data to confirm one or more hints, at 404 or when arriving at potential parks in 408. Thus, if consolidated signal data suggests (but is not conclusive perhaps) that asset 30 is parked in parking spot (R-1,3) and the independent indicator was the suggestion to park in lane R-1 then the independent indicator may be used to confirm the suspected (R-1,3) parking spot at 404.

At 406 method 400 collects information about site 12 that allows potential parks to be determined. For example, at 406 all RTs 32 in site 12 may be collected so that if consolidated signal data set includes a signal from one of them then a potential park can be determined. Similarly all ATs 32 and gateways 46 in site 12 may be collected. This collection may be static but may comprise at least a portion that is dynamic (such as ATs 32 of assets that are moving into and out of site 12). Failure to obtain all RTs/ATs/gateways may result in a failure to properly identify all potential parks and/or failure to rule out potential parks.

At 408 one or more potential parks (PP) are determined, to create a set of potential parks. Potential parks can be determined, for example, by considering or applying one or more potential park rules (or a set of potential park rules) to each signal in a consolidated signal data set (or even a signal data set):

1) Consolidated signal data set including a signal from an RT 28 located at the front of a lane, in the middle of a lane, or near a boundary, thus the asset (and AT thereon) is proximate to RT 28 (generally either in front of or behind RT 28 depending on the arrangement of AT on asset 30, and RT 28);
2) Consolidated signal data set including a signal from an AT 32 in a known/real position (such as a parking spot or in a boundary), thus the asset (and AT 32 thereon) is proximate to AT 32 (which may be a pAT, and is generally either in front of or behind AT 32 depending on the arrangement of AT on asset 30, and AT 32);
3) Consolidated signal data set including a signal from an AT 32 in a virtual position, thus the asset (and AT 32 thereon) is proximate to AT 32 in a virtual (which may be a pAT, and is generally either in front of or behind AT 32 depending on the arrangement of AT on asset 30, and AT 32);
4) Consolidated signal data set including signals from one or more RTs 28 and ATs 32 that combine to suggest/trilaterate asset 30 to a location;
5) Note that some PPs may be eliminated at 408, for example if PPs suggest a parking spot outside bay 14 when a chokepoint has already indicated to location management system 44 that asset 30 is in bay 14 (for example a hint at 404 may assist in eliminating PPs).

Potential parks have a strength associated with them, which generally may be the strength of the signal leading to the PP—though other factors may affect the strength of the PP, such as reliability of the hardware providing the signal, the nature of the potential park or hardware, and the like.

At 410 if no PPs exist then at 412 a delay is performed. The delay may, for example, allow another asset 30 to finish its parking so that that AT 32 can subsequently be obtained at 406 and then asset 30 may be parked. This may occur, for example if asset 30 parks behind another asset that has not yet parked but once it does then a potential park will be obtained by asset 30 having a signal from the newly parked asset in its consolidated signal data set. After the delay at 412 the park process ends at 414 and method 300 will be recommenced as described herein.

At 410 if PPs exist then method 400 continues at 416 to execute one or more local analyses (analysis of the potential parks to arrive at a current parking result, such as 416/418/424/428/etc) of the potential parks. At 416 method method 400 continues to see if the strongest PPs (configurable, but at least one PP) indicate the same location. If so method 400 continues to 418 determine if the strongest PP (PP1) is stronger than or exceeds a boundary threshold. The boundary threshold may be configurable and may depend on what type of PP it is. In one embodiment the boundary threshold may be −75 db.

If PP1 exceeds the threshold then asset 30 is added to a park queue at the location indicated by PP1 and method 400 ends at 414.

If PP1 does not exceed the boundary threshold then at 430 asset 30 is added to a park queue for a temporary or virtual lane at position 0 in that lane (as if asset 30 was to be conclusively put in a 'non-zero' position in a temporary lane then there would have been a PP associated with asset 30 in the temporary lane in front of asset 30). Method 400 then ends at 414.

Returning to 416, if the result is "no" then method 400 continues to 422 to obtain a Signals Too Similar (STS) value. This may be obtained from a configuration file or other source that may be part of location management system 44.

At 424 the strongest two (or more) PPs are compared and at 426 if the strength of the compared PPs are not within STS then at 436 the strongest PP is compared to a boundary threshold (the same or different from 418 or others). If the PP exceeds the boundary then asset 30 is added to park queue (for real locations) at the location of the strongest PP and method 400 ends. Otherwise method 400 continues at 430, which is as described herein.

Returning to 426 if the PPs are with STS then if one PP does not match a hint (i.e. confirms the hint of where the driver of asset 30 was told to park, for example) then method 400 proceeds to 430. Otherwise the PP is compared to a boundary threshold at 432 (again the same or different from other boundary thresholds herein). If the threshold is exceeded then asset 30 is added to the park queue at the location of the hint and method 400 ends, otherwise method 400 simply ends.

Method 400 ends at 414, and at such stage a current parking result will generally have been determined. A current parking result from method 400 may be a real parking spot (in a lane or not), a virtual parking spot (in a lane or not), a boundary, and the like. Of course a parking result may also be that there is no parking location (virtual, real, lane, boundary or otherwise) though that is generally if a particular asset 30 has not yet been through method 400 or most recently removed itself from parking (i.e. unparked).

When method 400 ends, method 300 ends until a further trigger for obtaining a location for a moveable asset occurs.

Figure 5:
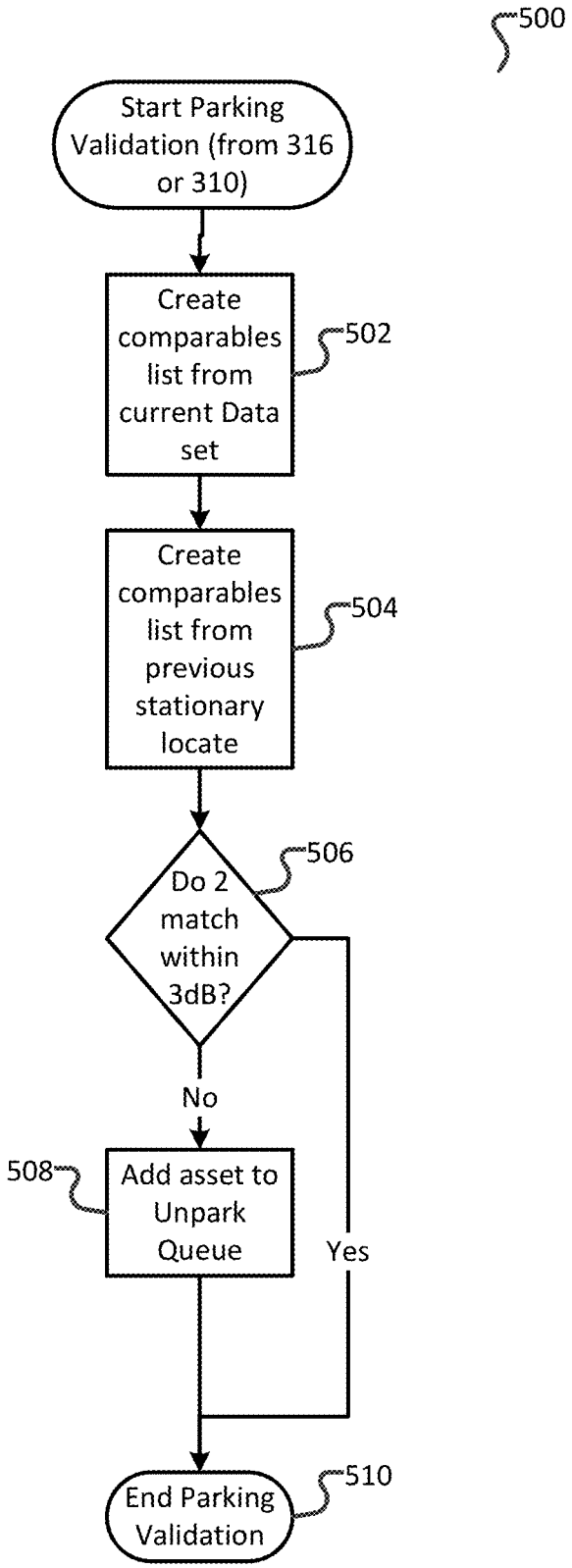
FIG. 5 shows a method for parking validation according to an embodiment of the invention.

Returning to method 300, if a real or temporary location is obtained at 302 then method 300 continues to perform parking validation, as described in method 500 in FIG. 5. Parking validation is performed to ensure that the obtained location is in fact still valid—as sometimes systems 10 may rely on other components or may be affected by other components such that unpark operations or park operations are not updated when a location is obtained at 302.

Turning to FIG. 5, method 500 begins at 502 where a comparables list is created from the current signal data set (which may be a raw signal data set of a consolidated signal data set). A comparables list as used herein is a list of signals from RTs 28, ATs 32*s* or gateways 46, received by asset 30 at a point in time. The current signal data set may already be in memory or may be obtained via processes akin to 304 and 306.

At 504 a similar list, a prior signal data set (raw or consolidated) is created from one or more previous location determinations. Such data may have been stored by location management system 44 during other iterations of method 300. At the end of 504 method 500 may have the two most recent signal data sets, a current and a prior, for asset 30.

At 506 a comparison between the comparables list to determine if asset 30 has moved. Different tests may be employed at 506 but in one embodiment if two items in the comparables list match within a threshold (3 db at present) then method 500 determines that asset 30 has remained parked, sets the current parking result to be the same as the prior parking result (or simply does not change the prior parking result) and validation ends at 510. Also, some ATs and RTs may have moved and thus no longer provide a signal to asset 30. Thus a holistic approach to determining whether asset 30 has moved may be taken, as opposed to requiring the two lists to be completely the same, or contain the same signals or signal strengths. Otherwise asset 30 is added to an unpark queue at 508 then parking validation ends at 510.

Returning to method 300, if a real location had been determined then method 300 continues to 318 from performing parking validation.

From 318 method 300 proceeds to method 700 in FIG. 7. Method 700 is for filling gaps that may arise in real lanes as a result of a failure to properly locate assets 30. At a high level method 700 may be attempting to identify assets 30 that are in temporary lanes but ought to be in real locations, such as gaps in lanes.

Method 700 begins at 702 to obtain a boundary type. If the boundary type is non-sequenced (such as if asset 30 is in boundary 48) then method 700 ends at 704. Otherwise method 700 continues to 706 to obtain a current position, which would be a real position, and a sequenced position. At 708 the position/location of another asset 30 that is in front of asset 30 in question is obtained.

At 710 if no gap exists then method 700 ends at 736. A finding of no gap would mean that asset 30 in front of asset 30 would be providing a signal to asset 30 that resulted in a PP that was determined to be the location for asset 30 (i.e. exceeding applicable thresholds and the like).

If a gap is identified then a list of all assets 30 in temporary lanes ("Temp Lane Assets") is created at 712.

Next at assets 30 are identified in a list that are behind the gap, superadjacent to the gap (i.e. in lanes with higher lane numbers than the current lane) and subadjacent to the gap (i.e. in lanes with lower lane numbers than the current lane) (such assets 30 being called "Gap Assets").

Then at 716 three lists of assets 30 that are proximate to the Gap Surrounding Assets are created (such being called "Gap Assets Neighbors")—one for each of "behind gap", "subadjacent to gap" and "superadjacent to gap".

At 718 three new lists are created to augment the three lists at 716 where Gap Assets Neighbors are kept in the corresponding new list if an asset is both a Gap Assets Neighbors and are in the Temp Lane Assets, such assets 30 being "Matched Assets" ("MA").

At 720 a Signal Too Similar ("STS") value is obtained (which may be the same as in other methods or may be different).

At 722 the strongest MA (MA1) is compared to the second strongest (MA2). If they are within the STS then method 700 continues to 726. If at 726 the two strongest MAs are not the same then method 700 ends at 736. If they are the same, or the comparison at 724 is not within the STS then method continues to 728.

At 728 if MA1 exceeds a boundary threshold (being the same or different from other such thresholds) then a check occurs whether MA1 is already in a queue to be parked. If not then a check is made whether MA1's data supports being parked based on its consolidated signal data set. If so then MA1 is added to a park queue in the identified gap.

If MA1 is lower than the threshold at 728, if MA1 is in a queue to be parked at 730, or if MA1's data does not support a park, then method 700 ends at 736.

Method 300 then resumes, awaiting for another trigger to obtain a location.

Figure 6:
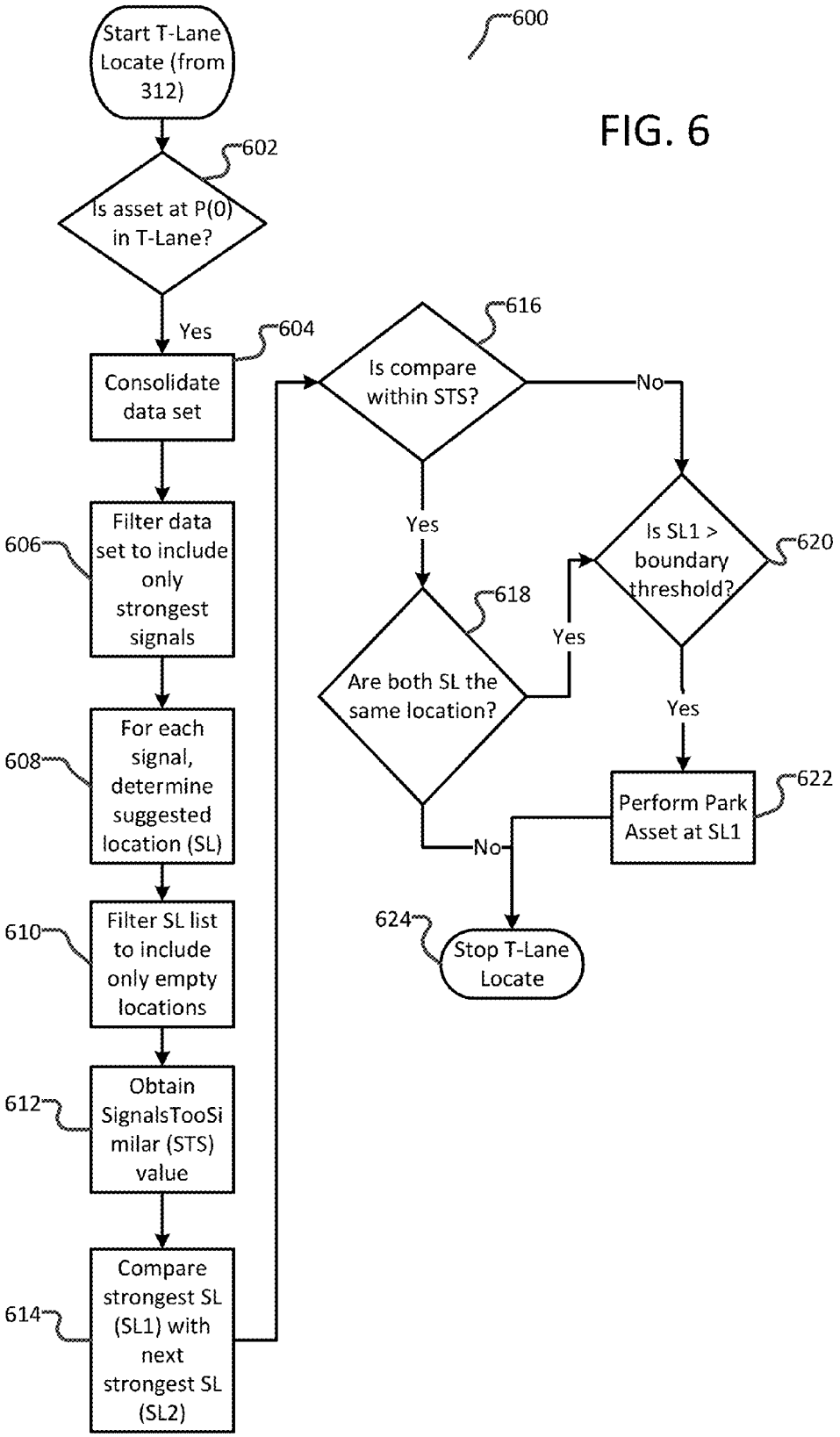
FIG. 6 shows a method for temporary lane locating of assets according to an embodiment of the invention.

If the obtained location or (current) parking result at 302 is a temporary lane or parking spot then method 300 proceeds to 310 as described herein, and then to 312 to perform a t-lane locate as described in method 600 in FIG. 6.

Method 600 in FIG. 6 is to attempt to locate asset 30 that is in a temporary lane, in a real spot. This may occur, for example, where it was unclear which lane asset 30 was in when it was being parked. It is preferable for assets 30 that are in real parking spots to be stored accurately as being in real spots.

Method 600 begins at 602 to determine if asset 30 is in position zero in its t-lane. If so method 600 proceeds to 604 and 606, which may be substantially similar to  and .

At 608, for each signal in the consolidated signal data set a suggested location is determined.

At 610 the list of suggested locations is edited to only include empty locations. It is at this stage that a previous ambiguity may be corrected (where asset 30 may have been potentially placed in two parking spots). At 610 one of the two (for example) potential spots may be conclusively full.

At 612 a STS value (similar or different to others) is obtained and compared to the strongest suggested location (SL1) remaining at 614.

If the compare at 614 is within STS then at 618 if both SLs are the same then the strongest SL is compared to a threshold at 620, leading to parking asset 30 at SL1.

If the compare at 616 is not within STS then SL1 is compared to a threshold at 620 and asset 30 is parked at SL1 if the threshold is exceeded.

If the SLs are not the same, or the threshold is not exceeded at 620 then method 600 ends at 624.

It is to be understood that RTs and ATs are generally used herein to assist in determining where asset 30 is located and to sequence asset 30. As such, the number, characteristics, and locations of RTs and ATs within site 12 may be chosen to accomplish such locating and sequencing. In particular choices may be made to provide specific analyses as described herein, and specific analyses that increase the confidence of properly locating and sequencing assets 30.

This concludes the description of the presently preferred embodiments of the invention. The foregoing description has been presented for the purpose of illustration and is not intended to be exhaustive or to limit the invention to the precise form disclosed. It is intended the scope of the invention be limited not by this description but by the claims that follow.

What is claimed is:

1. A method for tag-based locating of moveable assets, at a site having one or more pre-existing moveable assets therein, each having one or more pre-existing moveable asset tags (pAT), the site further having one or more reference tags (RT), and the moveable assets having an asset tag (AT) thereon, the system comprising:

receiving, by the AT, a signal set comprising a signal from each pAT and RT at the site within a communicable range of the AT;

consolidating, by the AT, the signal data set into a consolidated signal data set by applying one or more consolidation rules to the signal set;

communicating, by the AT, the consolidated signal set to a location management system;

obtaining a set of potential parks for the AT;

applying one or more local analyses to the set of potential parks for the AT; and specifying a current parking result for the AT based on the applying.

2. The method of claim 1 wherein the consolidation rules comprise:

rejecting i) any signal that is below a threshold signal strength and ii) any signal that is weaker than a strongest signal in the signal data set by more than a threshold signal strength difference.

3. The method of claim 2 wherein the obtaining further comprises:

for each signal in the consolidated signal data set, considering each potential park rule in a set of potential park rules; and adding a potential park to the set of potential parks if the considering results in a potential park.

4. The method of claim 3 wherein the potential park rules comprise:

if a signal in the consolidated signal data set includes a signal from an RT, then a potential park is proximate to the RT; and if a signal in the consolidated signal data set includes a signal from an AT, then a potential park is proximate to the AT.

5. The method of claim 4 wherein the potential park rules further comprise:

if a signal in the consolidated signal data set includes a signal from an AT in a virtual parking spot, then a potential park is proximate to the AT and in a virtual lane.

6. The method of claim 1 further comprising:

requesting a signal data set based on a trigger.

7. The method of claim 6 where the trigger is one of a stopped trigger, motion trigger or a stationary trigger.

8. The method of claim 7 further comprising:

storing a prior parking result for the asset;

if the prior parking result is a parking spot, boundary, or a virtual parking spot then;

validating the prior parking result;

if the prior parking result is validated then:

setting the current parking result to be the same as the prior parking spot.

9. The method of claim 8 wherein the validating further comprises:

retrieving a prior signal data set for the asset;

comparing the prior signal data set to the current signal data set; and if the prior signal data set is equivalent to the current signal data set then:

issuing a validation.

10. The method of claim 1 wherein the current parking result is i) a parking spot if AT is in a parking spot, ii) a boundary if AT is in a boundary and iii) a virtual parking spot if AT is not in a parking spot or a boundary.

11. A system for tag-based locating of moveable assets, at a site having one or more pre-existing moveable assets therein, each having one or more pre-existing moveable asset tags (pAT), the site further having one or more reference tags (RT), and the moveable assets having an asset tag (AT) thereon, the system comprising:

a moveable asset to locate at a site, the asset having an AT thereon operable to communicate with pATs and RTs, the AT configured to:

receive a signal set comprising a signal from each pAT and RT at the site within a communicable range of the AT;

consolidate the signal data set into a consolidated signal data set by applying one or more consolidation rules to the signal set;

communicate the consolidated signal set to a location management system; and a location management system configured to:

obtaining a set of potential parks for the AT;

applying one or more local analyses to the set of potential parks for the AT; and specifying a current parking result for the AT based on the applying.

12. The system of claim 11 wherein the consolidation rules comprise:

rejecting i) any signal that is below a threshold signal strength and ii) any signal that is weaker than a strongest signal in the signal data set by more than a threshold signal strength difference.

13. The system of claim 12 wherein the obtaining further comprises:

for each signal in the consolidated signal data set, considering each potential park rule in a set of potential park rules; and adding a potential park to the set of potential parks if the considering results in a potential park.

14. The system of claim 13 wherein the potential park rules comprise:

if a signal in the consolidated signal data set includes a signal from an RT, then a potential park is proximate to the RT; and if a signal in the consolidated signal data set includes a signal from an AT, then a potential park is proximate to the AT.

15. The system of claim 14 wherein the potential park rules further comprise:

if a signal in the consolidated signal data set includes a signal from an AT in a virtual parking spot, then a potential park is proximate to the AT and in a virtual lane.

16. The system of claim 11 further comprising:

requesting a signal data set based on a trigger.

17. The system of claim 16 where the trigger is one of a stopped trigger, motion trigger or a stationary trigger.

18. The system of claim 17 wherein the location management system is further configured to:

store a prior parking result for the asset;

if the prior parking result is a real parking spot, boundary, or a virtual parking spot then;

validate the prior parking result;

if the prior parking result is validated then:

set the current parking result to be the same as the prior parking spot.

19. The system of claim 18 wherein the location management system is further configured, to validate the prior parking, to:

retrieve a prior signal data set for the asset;

compare the prior signal data set to the current signal data set; and if the prior signal data set is equivalent to the current signal data set then:

issue a validation.

20. The system of claim 11 wherein the current parking result is i) a parking spot if AT is in a parking spot, ii) a boundary if AT is in a boundary and iii) a virtual parking spot if AT is not in a parking spot or a boundary.

21. A method for tag-based locating of moveable assets, at a site having one or more pre-existing moveable assets therein, each having one or more pre-existing moveable asset tags (pAT), the site further having one or more reference tags (RT), and the moveable assets having an asset tag (AT) thereon, the system comprising:

receiving by the AT a signal set comprising a signal from each pAT and RT at the site within a communicable range of the AT;

consolidating by the AT the signal set into a consolidated signal data set by applying one or more consolidation rules to the signal set;

communicating the consolidated signal set to a location management system;

obtaining a set of potential parks for the AT, wherein a potential park comprises a suggestion of a parking spot the moveable asset is currently parked in;

applying one or more local analyses to the set of potential parks for the AT; and specifying a current parking result for the AT based on the applying.

* * * * *